US011492742B2

(12) United States Patent
Cha et al.

(10) Patent No.: US 11,492,742 B2
(45) Date of Patent: Nov. 8, 2022

(54) WASHER FOR ADJUSTING AMOUNT OF THE DETERGENT AND METHOD OF OPERATING THEREOF

(71) Applicant: LG ELECTRONICS INC., Seoul (KR)

(72) Inventors: Seung Chul Cha, Gyeonggi-do (KR); Bon Kwon Koo, Seoul (KR); Hyun Ji Park, Seoul (KR); Sang Hyun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 194 days.

(21) Appl. No.: 16/653,227

(22) Filed: Oct. 15, 2019

(65) Prior Publication Data

US 2020/0141040 A1 May 7, 2020

(30) Foreign Application Priority Data

Sep. 2, 2019 (KR) ..... 10-2019-0108306

(51) Int. Cl.
*D06F 33/37* (2020.01)
*D06F 34/24* (2020.01)
(Continued)

(52) U.S. Cl.
CPC ..... *D06F 33/37* (2020.02); *D06F 34/18* (2020.02); *D06F 34/22* (2020.02); *D06F 34/24* (2020.02)

(58) Field of Classification Search
CPC ..... D06F 18/00; D06F 25/00; D06F 33/00; D06F 33/36; D06F 33/37; D06F 33/57; D06F 34/18; D06F 34/22; D06F 34/28; D06F 35/00–008; D06F 37/00; D06F 39/00; D06F 39/007; D06F 39/02; D06F 39/022; D06F 39/024; D06F 39/026; D06F 39/028; D06F 58/00–04; D06F 58/20; D06F 58/203; D06F 58/30; D06F 58/38; D06F 58/50; D06F 2103/00; D06F 2103/02; D06F 2103/04; D06F 2103/06; D06F 2103/08; D06F 2103/20; D06F 2103/22; D06F 2105/42; D06F 2105/05; D06F 2202/00–12; D06F 2204/00–10; D06F 2210/00; D06F 2212/00–06; D06F 2214/00; D06F 2216/00; D06F 2220/00; D06F 2222/00; D06F 2224/00; D06F 2226/00
See application file for complete search history.

(56) References Cited

U.S. PATENT DOCUMENTS 5,083,447 A * 1/1992 Kiuchi ..... G01N 21/534 68/12.05
5,235,827 A * 8/1993 Kiuchi ..... D06F 33/44 68/12.04
(Continued)

FOREIGN PATENT DOCUMENTS

KR 20050000096 1/2005
KR 20110023063 3/2011

*Primary Examiner* — David G Cormier
(74) *Attorney, Agent, or Firm* — Fish & Richardson P.C.

(57) ABSTRACT

Disclosed are a washer for adjusting an amount of detergent and a method of driving the same, which controls an automatic detergent dispenser to decide the amount of detergent on an amount of contamination of laundry by using artificial intelligence or machine learning, and to input the determined amount of detergent to washing water.

12 Claims, 6 Drawing Sheets

(51) Int. Cl.
*D06F 34/18* (2020.01)
*D06F 34/22* (2020.01)

(56) References Cited

U.S. PATENT DOCUMENTS

| | | | | | |
|---|---|---|---|---|---|
| 5,446,531 | A * | 8/1995 | Boyer | A47L 15/4297 | 356/72 |
| 5,477,576 | A * | 12/1995 | Berkcan | D06F 34/22 | 8/158 |
| 2006/0216217 | A1* | 9/2006 | Chan | D06F 34/22 | 422/218 |
| 2010/0101030 | A1* | 4/2010 | Kim | D06F 33/37 | 8/159 |
| 2018/0002857 | A1* | 1/2018 | Hombroek | D06F 34/18 | |
| 2018/0305851 | A1* | 10/2018 | Kwon | D06F 34/05 | |

* cited by examiner

<OBTAIN PRIMARY AMOUNT OF CONTAMINATION>

WASHER FOR ADJUSTING AMOUNT OF THE DETERGENT AND METHOD OF OPERATING THEREOF

CROSS-REFERENCE TO RELATED APPLICATION

This application claims benefit of priority to Korean Patent Application No. 10-2019-0108306, filed on Sep. 2, 2019, the entire disclosure of which is incorporated herein by reference.

BACKGROUND

1. Technical Field

The present disclosure relates to a washer for adjusting the amount of the detergent and a method of operating the same, which decides the amount of the detergent based on the amount of the contamination of laundry, and controls an automatic detergent dispenser to input detergent into washing water by the amount of the detergent.

2. Description of Related Art

A washer corresponds to a device for processing washing of laundry. When the laundry is input and a washing start command is received, the washer may operate to automatically decide a washing setting (for example, an operating course of the laundry (wool washing, bedding washing, general washing, and the like), the amount of water, the number of rinsing times, or the like) based on the amount of the laundry (or, volume and weight), or receive the washing setting from a user, and operate according to the received washing setting.

At this time, the washer proceeds to the washing by using the detergent arbitrarily input by the user. However, as the user arbitrarily inputs the detergent, it is difficult to decide the amount of the detergent suitable for laundry, and to input the detergent by the decided amount of the detergent.

As a method of deciding the amount of the detergent, the related art 1 discloses a method of sensing the amount of the laundry, and calculating the amount of the detergent according to the sensed amount of the laundry. In addition, the related art 2 discloses a method of deciding the amount of the detergent by sensing the washing water level when the washing water is fed to the water feeding level set according to the amount of the laundry.

The related art 1 and the related art 2 may provide the amount of the detergent based on the amount of the laundry or the washing water level.

However, the related art 1 and the related art 2 only consider the amount of the laundry or the washing water level when deciding the amount of the detergent, and does not consider the amount of the contamination of the laundry, such that there is a possibility that the laundry having a high amount of the contamination may not be washed cleanly.

Accordingly, there is a need for a technology capable of washing laundry cleanly regardless of the amount of the contamination of laundry by deciding the amount of the detergent based on the amount of the contamination of laundry.

RELATED ART DOCUMENTS

Patent Documents

Related Art 1: Korean Patent Publication No. 10-2011-0023063

Related Art 2: Korean Patent Publication No. 10-2005-0000096

SUMMARY OF THE DISCLOSURE

An object of an embodiment of the present disclosure is to provide a washer for adjusting the amount of the detergent and a method of operation the same, which may decide the amount of the detergent based on the amount of the contamination of laundry, and control an automatic detergent dispenser to input the detergent into washing water by the amount of the detergent, thereby cleanly washing the laundry regardless of the amount of the contamination of the laundry.

Another object of an embodiment of the present disclosure is to obtain the amount of the contamination of laundry (that is, the amount of change in a contamination level of washing water) through a turbidity sensing sensor configured to sense the contamination level of the washing water based on the calibrated conductivity and light transmittance according to the temperature of the washing water, thereby accurately measuring the amount of the contamination of laundry to input the detergent by the amount of the detergent suitable for the amount of the contamination.

In addition, still another object of an embodiment of the present disclosure is to determine the amount of the detergent by using a deep neural network model trained to determine the amount of the detergent necessary for washing according to various information (for example, the amount of the contamination, the amount of the laundry, the temperature of the washing water, the operating course of the laundry, and the type of the laundry), thereby determining the amount of the detergent suitable for the laundry more easily and quickly.

An embodiment of the present disclosure may be a washer for adjusting the amount of the detergent, as the washer for adjusting the amount of the detergent based on the amount of the contamination of laundry, including a water supplier configured to supply washing water to an outer tub of the washer according to a washing start command, a driver configured to perform washing of the laundry by rotating an inner tub of the washer, a turbidity sensing sensor disposed to contact the washing water in order to sense the contamination level of the washing water, an automatic detergent dispenser configured to supply detergent to the washing water, and a controller configured to decide the initial amount of the detergent based on a primary amount of the contamination first obtained by using the turbidity sensing sensor after the washing water has been supplied, and to perform a washing stroke in the driver, after controlling the automatic detergent dispenser to input the detergent of the decided initial amount of the detergent to the washing water.

An embodiment of the present disclosure may be the washer for adjusting the amount of the detergent in which the driver performs preprocessing washing when a predetermined small amount of the detergent is input to the washing water through the automatic detergent dispenser according to the control of the controller, and when a 1.5th amount of contamination has been obtained after the preprocessing washing by using the turbidity sensing sensor, and the controller decides the initial amount of the detergent, additionally based on the 1.5th amount of the contamination together with the amount of the laundry and the primary amount of the contamination.

An embodiment of the present disclosure may be the washer for adjusting the amount of the detergent in which the controller uses, as an input value, at least one information among the primary amount of the contamination, the 1.5th amount of the contamination, the amount of the laundry, the temperature of the washing water, the operating course of the laundry, and the type of the laundry, and decides the initial amount of the detergent by using a deep neural network model trained to determine the amount of the detergent necessary for washing according to the input value.

An embodiment of the present disclosure may be the washer for adjusting the amount of the detergent in which the controller obtains a secondary amount of the contamination by using the turbidity sensing sensor at the time point when the washing stroke has been performed for a predetermined time, and changes the washing stroke based on the increased amount of the contamination, when the secondary amount of the contamination has increased by a predetermined value or more compared to the primary amount of the contamination.

An embodiment of the present disclosure may be the washer for adjusting the amount of the detergent in which the controller decides an additional washing time based on the increased amount of the contamination, and changes the washing stroke so that the decided additional washing time is added at an initial washing time decided according to the amount of the laundry and the primary amount of the contamination.

An embodiment of the present disclosure may be the washer for adjusting the amount of the detergent in which the controller controls the automatic detergent dispenser to further decide an additional amount of the detergent based on the increased amount of the contamination, and to additionally input detergent to the washing water by the decided additional amount of the detergent.

An embodiment of the present disclosure may be the washer for adjusting the amount of the detergent in which when the remaining detergent of the automatic detergent dispenser is smaller than the additional amount of the detergent, the controller controls the automatic detergent dispenser to generate notification of the detergent additional supply to the automatic detergent dispenser, after stopping the washing stroke, when a difference between the remaining detergent and the additional amount of the detergent is a predetermined reference value or more, and to input all of the remaining detergents to the washing water, when the difference is smaller than the predetermined reference value.

An embodiment of the present disclosure may be the washer for adjusting the amount of the detergent in which the turbidity sensing sensor includes an electrical conductivity sensor configured to sense conductivity of the washing water, an optical sensor configured to sense light transmission of the washer water, a temperature sensor configured to sense the temperature of the washing water, and a Micro Controller Unit (MCU) configured to control the electrical conductivity sensor, the optical sensor, and the temperature sensor, and the MCU calibrates the conductivity sensed by the electrical conductivity sensor and the light transmission sensed by the optical sensor, according to the temperature sensed by the temperature sensor.

An embodiment of the present disclosure may be the washer for adjusting the amount of the detergent in which the turbidity sensing sensor senses the contamination level of the washing water, based on the calibrated conductivity and light transmission.

An embodiment of the present disclosure may be the washer for adjusting the amount of the detergent in which the controller controls the automatic detergent dispenser to decide the amount of fabric softener, based on the amount of the laundry, and to input fabric softener to the washing water by the decided amount of the fabric softener, when performing a rinsing stroke of the laundry, after the washing stroke.

An embodiment of the present disclosure may be the washer for adjusting the amount of the detergent in which the turbidity sensing sensor generates a reference sensed value by sensing the contamination level of the washing water, before the washing water is contaminated by the laundry, and generates a first contamination sensed value by sensing the contamination level of the washing water that has been supplied to the laundry and contaminated by the laundry, and the controller obtains, as the primary amount of the contamination, a difference between the reference sensed value and the first contamination sensed value.

An embodiment of the present disclosure may be the washer for adjusting the amount of the detergent in which the turbidity sensing sensor generates a second contamination sensed value by sensing the contamination level of the washing water, at the time point when the washing stroke has been performed for a predetermined time, and the controller obtains, as a secondary amount of the contamination, a difference between the first contamination sensed value and the second contamination sensed value.

An embodiment of the present disclosure may be a method of driving a washer for adjusting the amount of the detergent, as the method of driving the washer for adjusting the amount of the detergent based on the amount of the contamination of laundry, including supplying, by a water supplier in the washer, washing water to an outer tub of the washer, according to a washing start command, performing, by a driver in the washer, washing of the laundry by rotating an inner tub of the washer, firstly obtaining, by a controller in the washer, a primary amount of the contamination by using a turbidity sensing sensor, after the washing water has been supplied, deciding, by the controller in the washer, the initial amount of the detergent based on the obtained primary amount of the contamination, —the turbidity sensing sensor being disposed to contact the washing water in order to sense the contamination level of the washing water—, and controlling, by the controller, an automatic detergent dispenser to input the detergent of the decided initial amount of the detergent to the washing water, and then to perform a washing stroke.

An embodiment of the present disclosure may be the method of driving the washer for adjusting the amount of the detergent further including, after the obtaining the primary amount of the contamination, performing, by the driver, preprocessing washing, when a predetermined small amount of the detergent is input to the washing water through the automatic detergent dispenser, according to the control of the controller, and the deciding the initial amount of the detergent includes deciding, by the controller, the initial amount of the detergent, additionally based on a $1.5^{th}$ amount of the contamination, together with the amount of the laundry and the primary amount of the contamination, when the $1.5^{th}$ amount of the contamination has been obtained after the preprocessing washing by using the turbidity sensing sensor.

An embodiment of the present disclosure may be the method of driving the washer for adjusting the amount of the detergent in which the deciding the initial amount of the detergent additionally based on the $1.5^{th}$ amount of the contamination further includes using, by the controller, as an input value, at least one information among the primary amount of the contamination, the $1.5^{th}$ amount of the contamination, the amount of the laundry, the temperature of the washing water, the operating course of the laundry, and the type of the laundry, and deciding the initial amount of the detergent by using a deep neural network model trained to determine the amount of the detergent necessary for washing, according to the input value.

An embodiment of the present disclosure may be the method of driving the washer for adjusting the amount of the detergent further including, after the controlling to perform the washing stroke, obtaining, by the controller, a secondary amount of the contamination by using the turbidity sensing sensor, at the time point when the washing stroke has been performed for a predetermined time, and changing, by the controller, the washing stroke based on an increased amount of the contamination, when the secondary amount of the contamination has increased by a predetermined value or more compared to the primary amount of the contamination.

An embodiment of the present disclosure may be the method of driving the washer for adjusting the amount of the detergent in which the changing the washing stroke includes deciding, by the controller, an additional washing time based on the increased amount of the contamination, and changing, by the controller, the washing stroke so that the decided additional washing time is added, at an initial washing time decided according to the amount of the laundry and the primary amount of the contamination.

An embodiment of the present disclosure may be the method of driving the washer for adjusting the amount of the detergent in which the changing the washing stroke includes further deciding, by the controller, an additional amount of the detergent, based on the increased amount of the contamination, and controlling, by the controller, the automatic detergent dispenser to additionally input the detergent to the washing water by the decided additional amount of the detergent.

An embodiment of the present disclosure may be the method of driving the washer for adjusting the amount of the detergent in which the controlling the automatic detergent dispenser to additionally input the detergent to the washing water includes generating, by the controller, notification of the detergent additional supply to the automatic detergent dispenser, after stopping the washing stroke, if the difference between the remaining detergent and the additional amount of the detergent is a predetermined reference value or more when the remaining detergent of the automatic detergent dispenser is smaller than the additional amount of the detergent, and controlling, by the controller, the automatic detergent dispenser to input all the remaining detergents to the washing water if the difference is less than the predetermined reference value.

An embodiment of the present disclosure may be the method of driving the washer for adjusting the amount of the detergent further including, after the controlling to perform the washing stroke, deciding, by the controller, the amount of fabric softener based on the amount of the laundry, upon the rinsing stroke of the laundry, after the washing stroke, and controlling, by the controller, the automatic detergent dispenser to input the fabric softener to the washing water by the decided amount of the fabric softener.

In addition, other methods and other systems for implementing the present disclosure, and a computer-readable medium for storing a computer program for executing the above method may be further provided.

Other aspects, features, and advantages other than those described above will become apparent from the following drawings, claims, and detailed description of the present disclosure.

According to the present disclosure, it is possible to determine the amount of the detergent based on the amount of the contamination of laundry, and control the automatic detergent dispenser to input detergent into the washing water by the amount of the detergent, thereby cleanly washing the laundry regardless of the amount of the contamination of the laundry.

According to the present disclosure, it is possible to obtain the amount of the contamination of the laundry (that is, the amount of change in the contamination level of the washing water) through the turbidity sensing sensor configured to sense the contamination level of the washing water based on the calibrated conductivity and light transmittance according to the temperature of the washing water, thereby accurately measuring the amount of the contamination of laundry to input detergent by the amount of the detergent suitable for the amount of the contamination.

In addition, according to the present disclosure, it is possible to decide the amount of the detergent by using the deep neural network model trained to determine the amount of the detergent necessary for washing according to various information (for example, the amount of the contamination, the amount of the laundry, the temperature of the washing water, the operating course of laundry, and the type of laundry), thereby determining the amount of the detergent suitable for the laundry more easily and quickly.

The effects of the present disclosure are not limited to the effects mentioned above, and other effects not mentioned may be clearly understood by those skilled in the art from the following description.

DETAILED DESCRIPTION

Figure 1:
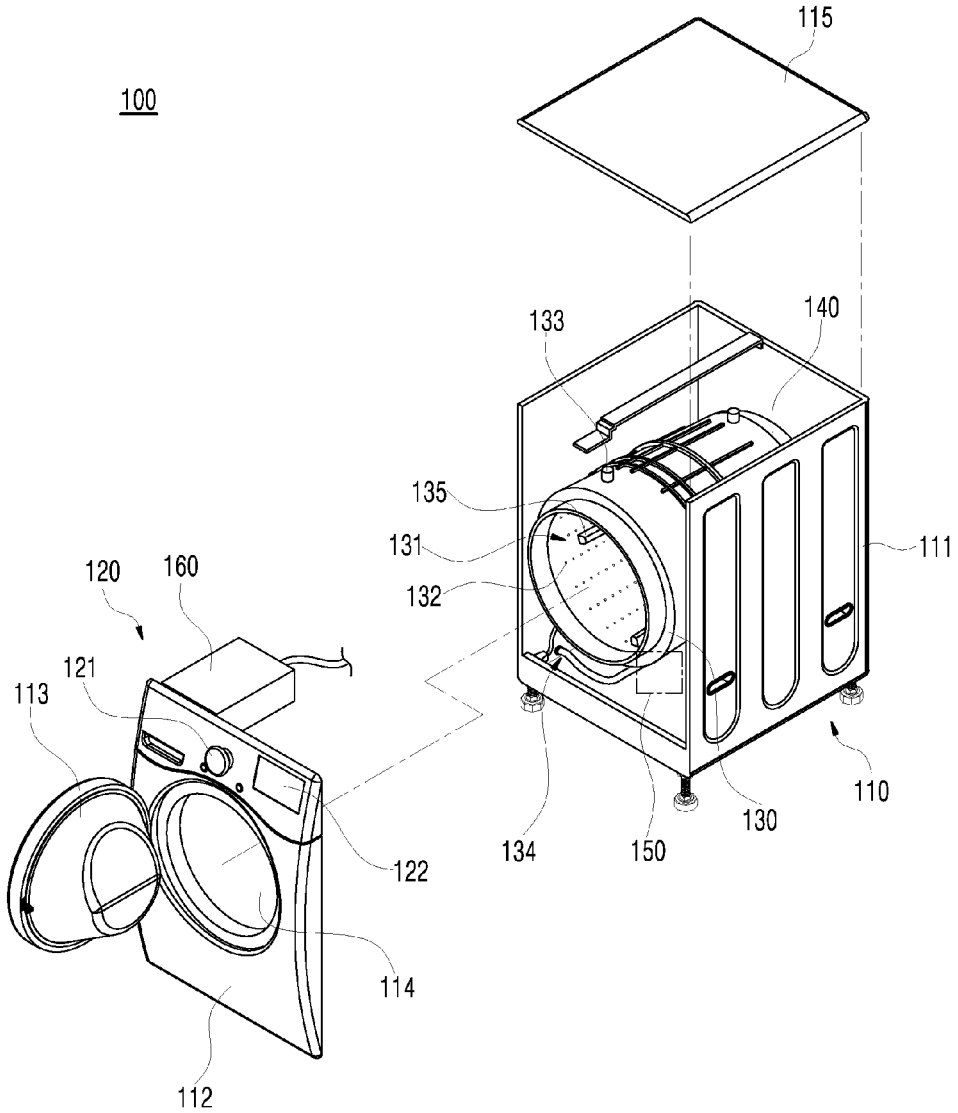
FIG. 1 is a diagram showing a configuration of a washer based on the amount of the contamination according to an embodiment of the present disclosure.

Advantages and features of the present disclosure and methods for achieving them will become apparent from the descriptions of aspects hereinbelow with reference to the accompanying drawings. However, the description of particular example embodiments is not intended to limit the present disclosure to the particular example embodiments disclosed herein, but on the contrary, it should be understood that the present disclosure is to cover all modifications, equivalents and alternatives falling within the spirit and scope of the present disclosure. The example embodiments disclosed below are provided so that the present disclosure will be thorough and complete, and also to provide a more complete understanding of the scope of the present disclosure to those of ordinary skill in the art. In the interest of clarity, not all details of the relevant art are described in detail in the present specification in so much as such details are not necessary to obtain a complete understanding of the present disclosure.

The terminology used herein is used for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "includes," "including," "containing," "has," "having" or other variations thereof are inclusive and Accordingly specify the presence of stated features, integers, steps, operations, elements, and/or components, but do not preclude the presence or addition of one or more other features, integers, steps, operations, elements, components, and/or groups thereof. Furthermore, these terms such as "first," "second," and other numerical terms, are used only to distinguish one element from another element. These terms are generally only used to distinguish one element from another.

Hereinafter, embodiments of the present disclosure will be described in detail with reference to the accompanying drawings. Like reference numerals designate like elements throughout the specification, and overlapping descriptions of the elements will not be provided.

A washer based on the amount of the contamination of the present disclosure is a device configured to remove the contamination stained on laundry by using water and detergent, and for example, a device configured to process the laundry through various actions such as washing, dehydration, and drying.

FIG. 1 is a diagram showing a configuration of a washer based on the amount of the contamination according to an embodiment of the present disclosure. Here, a drum washer corresponding to a front loader washer is shown as a washer based on the amount of the contamination of the present disclosure, but is not limited thereto, and the washer based on the amount of the contamination of the present disclosure may also be a top loader washer.

Referring to FIG. 1, a washer 100 based on the amount of the contamination according to an embodiment of the present disclosure may include a cabinet 110 forming an exterior, a tub 130 (an outer tub) provided inside the cabinet 110 and supported by the cabinet 110, a drum 131 (an inner tub) rotatably provided inside the tub 130 and to which laundry is input, a driver 140 configured to rotate the drum by applying torque to the drum 131, a user interface (UI) 120 that enables a user to select and execute a washing course, and a turbidity sensing sensor 150 configured to sense the amount of the contamination of laundry. At this time, the driver 140 may include, for example, a motor, and the UI 120 may include an input interface 121 and an output interface 122.

In addition, the cabinet 110 may include a main body 111, a cover 112 provided on the front surface of the main body 111, and a top plate 115 coupled to an upper part of the main body 111. The cover 112 may include an opening part 114 provided to allow the access of the laundry, and a door 113 for selectively opening and closing the opening part 114.

The drum 131 may form a space for washing the laundry put into the inside, and rotate by receiving power from the driver 140. Furthermore, since the drum 131 has a plurality of through holes 132, washing water stored in the tub 130 may be introduced into the drum 131 through the through holes 132, and the washing water inside the drum 131 may flow to the tub 130. Accordingly, when the drum 131 is rotated, the laundry introduced into the drum 131 may have dirt removed therefrom in the process of rubbing with the washing water stored in the tub 130. In addition, the drum 131 may further include a lifter 135 for stirring the laundry.

The UI 120 is a component that allows a user to input information related to the wash (including the entire cycle process of the washer 100 based on the amount of the contamination), and also identifies information related to the wash. That is, the UI is a component for providing an interface with the user. Accordingly, the UI 120 may include input interfaces 121 through which a user may input a control command, and an output interface 122 for displaying control information according to the control command. In addition, the UI 120 may include a controller (406 in FIG. 4) for controlling the driving of the washer 100 based on the amount of the contamination, including the operation of the driver 140 according to a control command. In the present embodiment, the UI 120 may refer to a control panel capable of input and output for control of the washer 100 based on the amount of the contamination. For this purpose, the UI 120 may be configured as a touch recognition display controller or various other input/output controllers. The touch recognition display controller may transmit and receive electrical signals with the controller 406. In addition, a touch-recognizable display controller may display a visual output to the user. Here, the visual output may include text, graphics, images, video, and combinations thereof. The UI 120 may be a display member such as an organic light emitting display (OLED) or a liquid crystal display (LCD) or a light emitting display (LED) capable of touch recognition, for example.

That is, in the present embodiment, the UI 120 may perform a function of the input interface 121 that receives a certain control command so that the user may control the overall operation of the washer 100 based on the amount of the contamination. In addition, the UI 120 may perform a function of the output interface 122 that may display an operating state (for example, a washing setting, a washing remaining time, or the like) of the washer 100 based on the amount of the contamination according to the control of the controller 406. Here, the operating state of the washer 100 may include, for example, a washing setting (for example, the operating course of the laundry (wool washing, bedding washing, general washing, and the like), the amount of water, the number of rinsing times, and the like), the washing progressing degree (washing stroke, rinsing stroke, dehydrating stroke, and the like), a washing remaining time, and the like.

In addition, in this embodiment, the washer 100 based on the amount of the contamination may include at least one water supply hose (not shown) for guiding water supplied from an external water source such as a faucet to the tub 130, and a water supplier 133 for controlling at least one water supply hose. In addition, the washer 100 based on the amount of the contamination may include the automatic detergent dispenser 160 configured to supply additives such as detergent and fabric softener into the tub 130 or the drum 131 according to the control of the controller 406, and additives may be separately contained in the automatic detergent dispenser 160 according to the type thereof. The automatic detergent dispenser 160 may include a detergent receiving part (not shown) for receiving detergent and a softening agent receiving part (not shown) for receiving fabric softener. Further, the washer 100 based on the amount of the contamination may include a water supply pipe (not shown) for selectively guiding water supplied through the water supplier 133 to each receiving part of the automatic detergent dispenser 160. The water supplier 133 may include a water supply valve for regulating each water supply pipe, and the water supply pipe may include water supply pipes to supply water to the detergent receiving part and the fabric softener receiving part, respectively.

Meanwhile, the drain unit 134 may include a drain port (not shown) for discharging water from the tub 130, and a pump (not shown) for pumping the discharged water. The pump may selectively perform a function of pumping the discharged water into a drain pipe (not shown) and a function of pumping the discharged water into a circulation pipe (not shown). Here, the water which is pumped by the pump and guided along the circulation pipe may be referred to as circulating water. The pump may include an impeller (not shown) for pumping water, a pump housing (not shown) for receiving the impeller, and a pump motor (not shown) for rotating the impeller. The pump housing is provided with an inlet port (not shown) through which water is introduced, a drain discharge port (not shown) through which the water pumped by the impeller is discharged to the drain pipe, and a circulating water discharge port (not shown) for discharging the water pumped by the impeller into the circulation pipe. Here, the pump motor may be capable of forward/reverse rotation. That is, in this embodiment, depending on the direction in which the impeller is rotated, water may be discharged through the drain discharge port, or water may be discharged through the circulating water discharge port. Such a configuration may be implemented by appropriately designing the structure of the pump housing, and since this technique is well known, a detailed description thereof will be omitted.

The pump may be capable of varying the flow rate (or, discharge water pressure), and for this, the pump motor constituting the pump may be a variable speed motor capable of controlling the rotational speed. The pump motor may be a brushless direct current motor (BLDC motor), but is not limited thereto. A driver for controlling the speed of the pump motor may be further provided, and the driver may be an inverter driver. The inverter driver may convert AC power to DC power, and input the DC power to the motor at the target frequency. In addition, the pump motor may be controlled by a controller. The controller may be configured to include a proportional-integral controller (PI controller) and a proportional-integral-derivative controller (PID controller). The controller may receive an output value (for example, an output current) of the pump motor as an input, and control the output value of the driver so that the rotational speed of the pump motor follows a predetermined target rotational speed based on the input. In addition, the controller may control the overall operation of the washer as well as the pump motor.

In the present embodiment, the washer 100 based on the amount of the contamination may include at least one balancer (not shown) on the front surface of the tub 130 along the perimeter of the tub 130. The balancer is for reducing the vibration of the tub 130. The balancer may be a weight having a predetermined weight, and may be provided in plurality. For example, balancers may be respectively provided at both the left and right sides of the front surface of the tub 130, and a balancer may be provided at the lower part of the front surface of the tub 130.

The turbidity sensing sensor 150 may be disposed to contact the washing water in order to sense the contamination level of the washing water. The washer 100 based on the amount of the contamination may change the washing stroke (for example, change at least one of the amount of the detergent or a washing time) based on the amount of the contamination obtained by using the turbidity sensing sensor 150. Here, the turbidity sensing sensor 150 may be disposed at the bottom of the front part of the washer 100 based on the amount of the contamination, but is not limited thereto.

Figure 2:
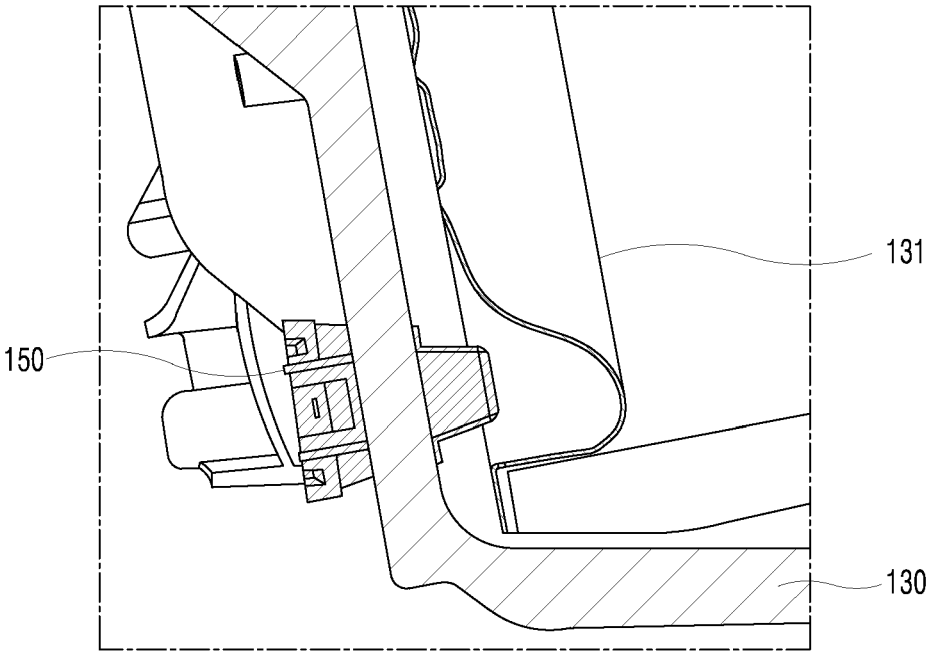
FIG. 2 is an exemplary diagram in which a turbidity sensing sensor has been installed in a washer based on the amount of the contamination according to an embodiment of the present disclosure.

FIG. 2 is an exemplary diagram in which a turbidity sensing sensor has been installed in a washer based on the amount of the contamination according to an embodiment of the present disclosure.

Referring to FIG. 2, the washer 100 based on the amount of the contamination may start washing by inputting laundry and detergent into a washing tub. The washing tub is composed of the inner tub 131 that is inputted with laundry and rotatable and the outer tub 130 surrounding the inner tub. Water supplied to the inner tub 131 of the washing tub is discharged to the outer tub 130 through a plurality of water through holes formed in the washing tub. Accordingly, during washing, the inner tub 131 and the outer tub 130 of the washing tub are submerged in the washing water and the rinsing water, and the contaminants using the washer 100 after washing or dehydration remain and accumulate in the washing tub. The turbidity sensing sensor 150 may be mounted where the water contacts in the washing tub. In an embodiment, the turbidity sensing sensor 150 may be disposed near the bottom of the washing tub in which water stays and drained for the longest time. The turbidity sensing sensor 150 may be mounted in a detachable structure in the washing tub. When the turbidity sensing sensor 150 is mounted to the washing tub in a detachable structure, the turbidity sensing sensor 150 may be easily replaced when the component is replaced.

Figure 3:
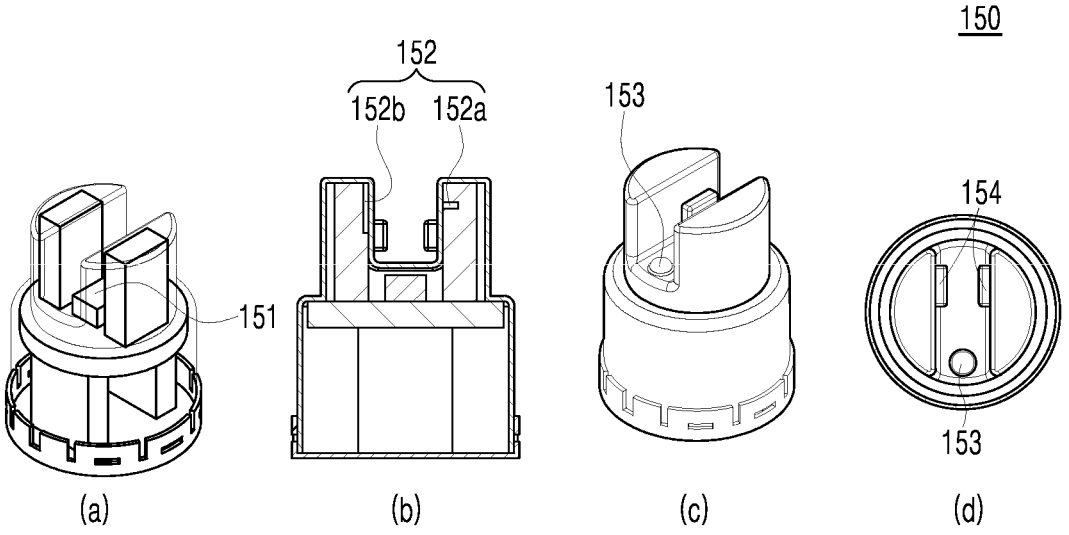
FIG. 3 is a diagram showing an internal configuration of a turbidity sensing sensor in the washer based on the amount of the contamination according to an embodiment of the present disclosure.

FIG. 3 is a diagram showing the internal configuration of a turbidity sensing sensor in a washer based on the amount of the contamination according to an embodiment of the present disclosure.

Referring to FIG. 3, the turbidity sensing sensor 150 in the washer based on the amount of the contamination may include an MCU 151 (*a*), an optical sensor 152 (*b*), a temperature sensor 153 (*c*), and an electrical conductivity sensor 154 (*d*).

Specifically, the turbidity sensing sensor 150 may include the electrical conductivity sensor 154 configured to sense conductivity in order to measure conductive contamination, the optical sensor 152 configured to sense light transmittance in order to measure non-conductive contamination, the temperature sensor 153 configured to sense a temperature, and the MCU 151 including a calibration algorithm that may calibrate a conductivity value and a transmittance value according to the temperature measured by the temperature sensor 153.

The optical sensor 152 includes an LED 152*a* configured to emit light and a phototransistor 152*b* configured to sense light emitted from the LED 152*a*. The MCU 151 converts analog signals generated by the temperature sensor 154 and the optical sensor 152 into digital signals and outputs conductivity data and transmittance data whose temperature have been calibrated by a calibration algorithm. Temperature data, temperature-calibrated conductivity data, and temperature-calibrated transmittance data may be output from the turbidity sensing sensor 150, and these data may be sensed values output from the turbidity sensing sensor 150. The MCU 151 of the turbidity sensing sensor 150 may transmit the conductivity data, the transmittance data, and the temperature data sensed by the turbidity sensing sensor 150 to the controller of the washer. The electrical conductivity sensor 154 is also referred to as an electrode sensor. Since the optical sensor 152 senses the degree of the transmission of light, the concept opposite to the transmission of light may also be indicated as turbidity. The turbidity is lower as the transmittance of light is higher in the liquid, and conversely, the turbidity is higher as the transmittance is lower.

Conventionally, the electrode sensor configured to sense conductivity, the optical sensor configured to sense the transmittance of light, and the temperature sensor configured to sense the temperature have been individually disposed in the washing tub, and these sensors have transmitted analog values to the controller of the washer, respectively. The controller of the washer has received these values to process, that is, converts the analog signal into the digital signal and then calibrates the conductivity value and the transmittance value based on the temperature received from the temperature sensor. Since the conductivity value, the transmittance value, and the temperature are delivered to the controller of the washer as the analog signal, a disturbance signal may be delivered due to the noise around the product, and accordingly, a sensitivity error and a temperature calibration error may occur. On the other hand, since the turbidity sensing sensor 150 in the washer for adjusting the amount of detergent of the present disclosure includes the temperature sensor 154, the optical sensor 152, the temperature sensor 153, and the MCU 151, and has integrated them into one module, the turbidity sensing sensor 150 converts the analog signal into the digital signal in one sensor unit, performs the temperature calibration for the conductivity value and the transmission value necessary for the detecting a contamination level, and then outputs the temperature-calibrated digital value. Accordingly, the turbidity sensing sensor 150 transmits the sensed value, which is the temperature-calibrated digital data, to the controller of the washer, thereby reducing the sensitivity error and the temperature calibration error, and increasing the accuracy of the sensed value by comparing with when the conventional sensors transmit the analog signal to the controller of the washer.

Figure 4:
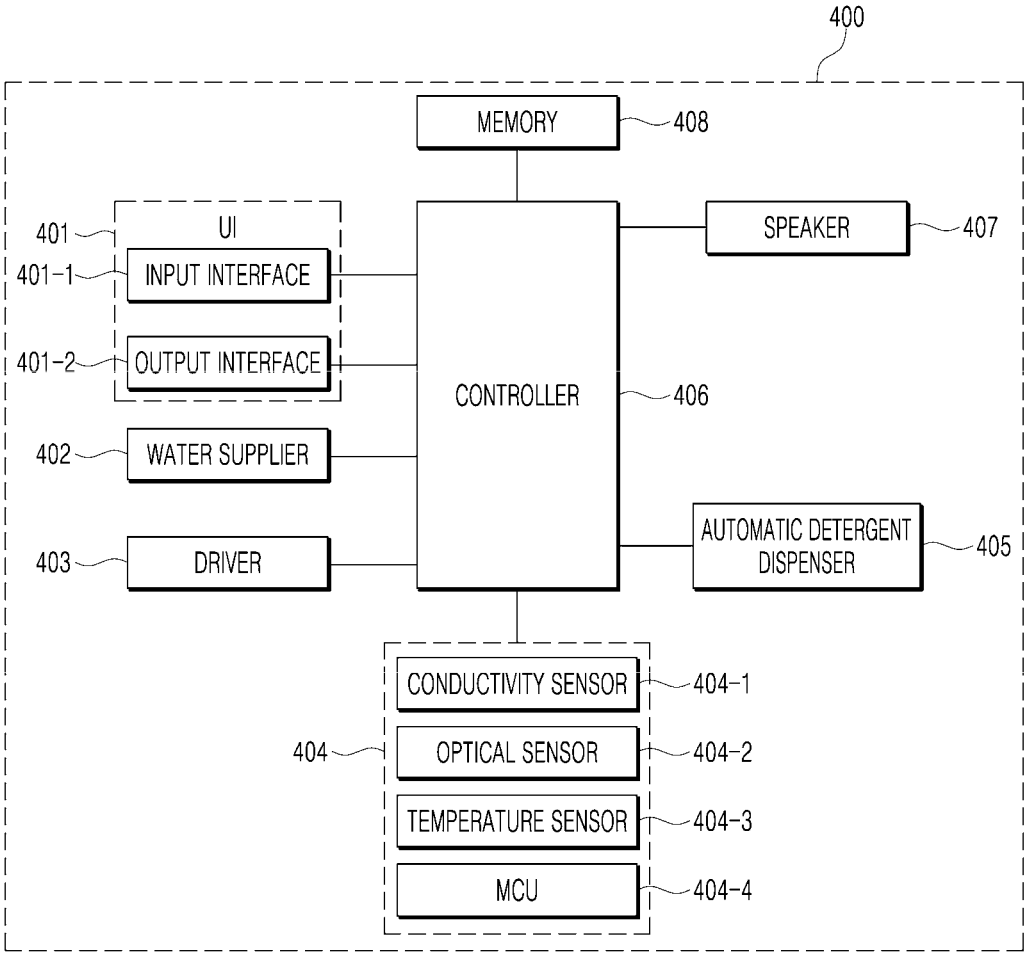
FIG. 4 is a block diagram schematically showing a washer based on the amount of the contamination according to an embodiment of the present disclosure.

FIG. 4 is a block diagram schematically showing a washer based on the amount of the contamination according to an embodiment of the present disclosure.

Referring to FIG. 4, a washer 400 based on the amount of the contamination may include, as the washer configured to adjust the amount of the detergent based on the amount of the contamination of the laundry, a user interface (UI) 401, a water supplier 402, a driver 403, a turbidity sensing sensor 404, an automatic detergent 405, a controller 406, a speaker 407, and a memory 408.

The UI 401 may include an input interface 401-1 and an output interface 401-2.

The input interface 401-1 may receive a predetermined control command from the user of the washer 400. Here, the control command may include, for example, a washing start and end command, an operating course of laundry (general washing, wool washing, bedding washing, and the like), the amount of water, the number of rinsing times, a temperature of water, and the like.

The output interface 401-2 may display control information according to the control command or the operating state (for example, a washing setting, a washing progressing level, a washing remaining time, and the like) of the washer.

The water supplier 402 may supply the washing water to the outer tub of the washer according to the washing start command input through the input interface 401-1.

The driver 403 may rotate the inner tub of the washer to perform washing of laundry. First, the driver 403 may wash the laundry only with the washing water supplied from the outer tub of the washer so as to obtain the primary amount of the contamination through the turbidity sensing sensor 404. Thereafter, the driver 403 may perform preprocessing washing, when a predetermined small amount of the detergent (for example, 5 ml) is input to the washing water through the automatic detergent dispenser 405 according to the control of the controller 406. In addition, the driver 403 may continue to perform the washing stroke in a state where the detergent has been input to the washing water through the automatic detergent dispenser 405 according to the control of the controller 406.

Thereafter, the driver 403 may perform the washing stroke followed by the rinsing stroke and the dehydrating stroke.

The turbidity sensing sensor 404 may be disposed to contact the washing water in order to sense the contamination level of the washing water, and may sense the contamination level according to the control of the controller 406 to generate a sensed value. Here, the sensed value may be a lower value as the contamination level is higher.

The turbidity sensing sensor 404 may include an electrical conductivity sensor 404-1, an optical sensor 404-2, a temperature sensor 404-3, and an MCU 404-4. Here, the conductivity sensor 404-1 may sense conductivity of the washing water. The optical sensor 404-2 may sense the light transmittance of the washing water. The temperature sensor 404-3 may sense the temperature of the washing water. In addition, the MCU 404-4 may control the conductivity sensor 404-1, the optical sensor 404-2, and the temperature sensor 404-3. The turbidity sensing sensor 404 may sense the contamination level of the washing water based on the calibrated conductivity and light transmittance, thereby accurately measuring the contamination level.

For another example, the turbidity sensing sensor 404 may deliver the calibrated conductivity and light transmittance to the controller 406. At this time, the controller 406 may determine the contamination level of the washing water based on the calibrated conductivity and light transmittance received from the turbidity sensing sensor 404, and estimate the amount of the contamination of the laundry based on the contamination level of the washing water.

When the contamination level is sensed, the turbidity sensing sensor 404 may first generate a reference sensed value by sensing the contamination level of the washing water before the washing water is contaminated by the laundry. Thereafter, the turbidity sensing sensor 404 may sense the contamination level of the washing water that has been supplied to the laundry and firstly contaminated by the laundry to generate a first contamination sensed value.

In addition, the turbidity sensing sensor 404 may sense the contamination level of the washing water after the preprocessing washing by the driver 403 to generate an intermediate contamination sensed value. Thereafter, the turbidity sensing sensor 404 may sense the contamination level of the washing water to generate a second contamination sensed value, at the time point when the washing stroke has been performed for a predetermined time after the detergent of the initial amount of the detergent determined by the controller 406 is input to the washing water.

The automatic detergent dispenser 405 may supply detergent and fabric softener to the washing water.

After the washing water has been supplied to the laundry, the controller 406 may firstly obtain the primary amount of the contamination by using the turbidity sensing sensor 404, thereby obtaining the amount of water-soluble contamination, and decide the initial amount of the detergent based on the obtained primary amount of the contamination. At this time, the controller 406 may obtain, as the primary amount of the contamination, a difference between a reference sensed value obtained by the turbidity sensing sensor 404 and the first contamination sensed value (for example, a result value obtained by subtracting the first contamination sensed value from the reference sensed value). In addition, the controller 406 may detect the amount of the laundry, and decide the initial amount of the detergent further based on the amount of the laundry together with the primary amount of the contamination.

In addition, for another example, the controller 406 may obtain the $1.5^{th}$ amount of the contamination after the preprocessing washing by using the turbidity sensing sensor 404, and decide the initial amount of the detergent additionally based on the $1.5^{th}$ amount of the contamination together with the amount of the laundry and the primary amount of the contamination. At this time, the controller 406 may obtain, as the $1.5^{th}$ amount of the contamination, a difference between the first contamination sensed value obtained by the turbidity sensing sensor 404 and the intermediate contamination sensed value (for example, a result value obtained by subtracting the intermediate contamination sensed value from the first contamination sensed value).

When deciding the initial amount of the detergent, the controller 406 may decide the initial amount of the detergent by using a deep neural network model mounted in the memory 408. At this time, the controller 406 may use, as an input value, at least one information among the primary amount of the contamination, the $1.5^{th}$ amount of the contamination, the amount of the laundry, the temperature of the washing water, the operating course of the laundry, and the type of the laundry (for example, towel, clothing, bedding, or the like), and decide the initial amount of the detergent by using a deep neural network model trained to determine the amount of the detergent necessary for washing according to the input value, thereby deciding the initial amount of the detergent more easily and quickly.

When the initial amount of the detergent is decided, the controller 406 controls the automatic detergent dispenser 405 to input the detergent of the decided initial amount of the detergent to the washing water, and then to perform the washing stroke in the driver 403. At this time, the controller 406 may decide the initial washing time according to the amount of the laundry and the primary amount of the contamination.

Thereafter, the controller 406 may obtain a secondary amount of the contamination by using the turbidity sensing sensor 404 at the time point when the washing stroke has been performed for a predetermined time after the detergent of the initial amount of the detergent has been input. At this time, the controller 406 may obtain, as the secondary amount of the contamination, a difference between the first contamination sensed value (or, an intermediate contamination sensed value) and the second contamination sensed value sensed by the turbidity sensing sensor 404 (for example, a result value obtained by subtracting the second contamination sensed value from the first contamination sensed value (or, the intermediate contamination sensed value)).

The controller 406 may compare the primary amount of the contamination (or, the $1.5^{th}$ amount of the contamination) and the secondary amount of the contamination, and change the washing stroke (for example, the amount of the detergent, a washing time, a washing RPM, a rotational speed, and the like) based on the increased amount of the contamination, when the secondary amount of the contamination has increased by a predetermined value or more compared to the primary amount of the contamination (or, the $1.5^{th}$ amount of the contamination) as the comparison result, thereby sufficiently removing the amount of the contamination. At this time, the controller 406 may decide an additional washing time based on the increased amount of the contamination, and change the washing stroke so that the decided additional washing time is added to the initial washing time decided according to the amount of the laundry and the primary amount of the contamination. When deciding the additional washing time, the controller 406 may decide the additional washing time based on the additional washing time for each change in the predetermined amount of the contamination, or decide the additional washing time by using a deep neural network model trained to determine the additional washing time according to the change in the amount of the contamination.

In addition, the controller 406 may further determine the additional amount of the detergent based on the increased amount of the contamination, and change the washing stroke by controlling the automatic detergent dispenser 405 to additionally input the detergent to the washing water by the additional amount of the detergent. When deciding the additional amount of the detergent, as in the decision of the additional washing time, the controller 406 may decide the additional amount of the detergent based on the additional amount of the detergent for each change in the predetermined amount of the contamination, or decide the additional amount of the detergent by using a deep neural network model trained to determine the additional amount of the detergent according to the change in the amount of the contamination.

When adding the detergent, the controller 406 may stop the washing stroke, and then generate notification of the additional detergent supply to the automatic detergent dispenser through the speaker 407, or transmit it to a pre-registered user terminal, when a difference between the remaining detergent and the addition amount of the detergent is a predetermined reference value or more in the case where the remaining detergent of the automatic detergent dispenser 405 is smaller than the additional amount of the detergent. Here, the user terminal may be a desktop computer, a smartphone, a notebook, a tablet PC, a smart TV, a mobile phone, a personal digital assistant (PDA), a laptop, a media player, a micro server, a global positioning system (GPS) device, an electronic book terminal, a digital broadcasting terminal, a navigation device, a kiosk, a MP3 player, a digital camera, a home appliance, and other mobile or non-mobile computing devices, which can be operated by the user, but is not limited thereto.

After the notification of the additional detergent supply, the controller 406 may control the automatic detergent dispenser 405 to input all of the remaining detergent to the washing water to resume the washing stroke, when no detergent is additionally supplied for a predetermined time.

On the other hand, when the difference is smaller than the predetermined reference value, the controller 406 may control the automatic detergent dispenser 405 to input all of the remaining detergent to the washing water.

The controller 406 may determine the amount of the fabric softener based on the amount of the laundry, and control the automatic detergent dispenser 405 to input the fabric softener to the washing water by the determined amount of the fabric softener, at the rinsing stroke of the laundry after the washing stroke.

The controller 406 may control the automatic detergent dispenser 405 to input the detergent and the fabric softener to the washing water by the determined amount when inputting the detergent (for example, the initial amount of the detergent or the additional amount of the detergent) and the fabric softener, thereby accurately inputting the amounts of the detergent and the fabric softener.

Thereafter, the controller 406 may control the driver 403 to perform the dehydration stroke, thereby completing washing.

At this time, the controller 406 may store at least one of the primary amount of the contamination, the $1.5^{th}$ amount of the contamination, the secondary amount of the contamination, the amount of the laundry, the temperature of the washing water, the operating course of the laundry, the type of the laundry, the initial amount of the detergent, the additional amount of the detergent, the initial washing time, and the additional washing time in the memory 408. The controller 406 may update the deep neural network model in the memory 408 by using the information stored in the memory 408, thereby increasing the accuracy of the deep neural network model.

The speaker 407 may output information related to an operation of the washer for adjusting the amount of detergent 400 as auditory data. That is, the speaker 407 may output the information related to the operation of the washer for adjusting the amount of the detergent 400 as audio data, and output a notification message such as a warning sound, an operating mode, an operating state, and an error state and an additional request for the amount of the detergent as an audio according to the control of the controller 406. In addition, the speaker 407 may convert an electrical signal from the controller 406 into an audio signal to output it.

However, as one exemplary embodiment, the speaker 407 is not limited in terms of its position and implementation method, and may include all output means for outputting an audio signal.

The memory 408 may store a deep neural network model (for example, a deep neural network model for determining at least one of the initial amount of the detergent, the additional washing time, and the additional amount of the detergent), and temporarily or permanently store data processed by the controller 406. For example, the memory 408 may store at least one of information on the washing setting (for example, the operating course of laundry (wool washing, bedding washing, general washing, and the like), the amount of water, the number of rinsing times, and the like), and information generated in the washing progressing process according to the washing setting, that is, the primary amount of the contamination, the $1.5^{th}$ amount of the contamination, the secondary amount of the contamination, the amount of the laundry, the temperature of the washing water, the operating course of the laundry, the type of the laundry, the initial amount of the detergent, the additional amount of the detergent, the initial washing time, and the additional washing time.

Here, the memory 408 may include magnetic storage media or flash storage media, but the scope of the present disclosure is not limited thereto. The memory 170 as described above may include magnetic storage media or flash storage media, but the scope of the present disclosure is not limited thereto. This memory 408 may include an internal memory and/or an external memory and may include a volatile memory such as a DRAM, a SRAM or a SDRAM, and a non-volatile memory such as one time programmable ROM (OTPROM), a PROM, an EPROM, an EEPROM, a mask ROM, a flash ROM, a NAND flash memory or a NOR flash memory, a flash drive such as an SSD, a compact flash (CF) card, an SD card, a Micro-SD card, a Mini-SD card, an XD card or memory stick, or a storage device such as a HDD.

Figure 5:
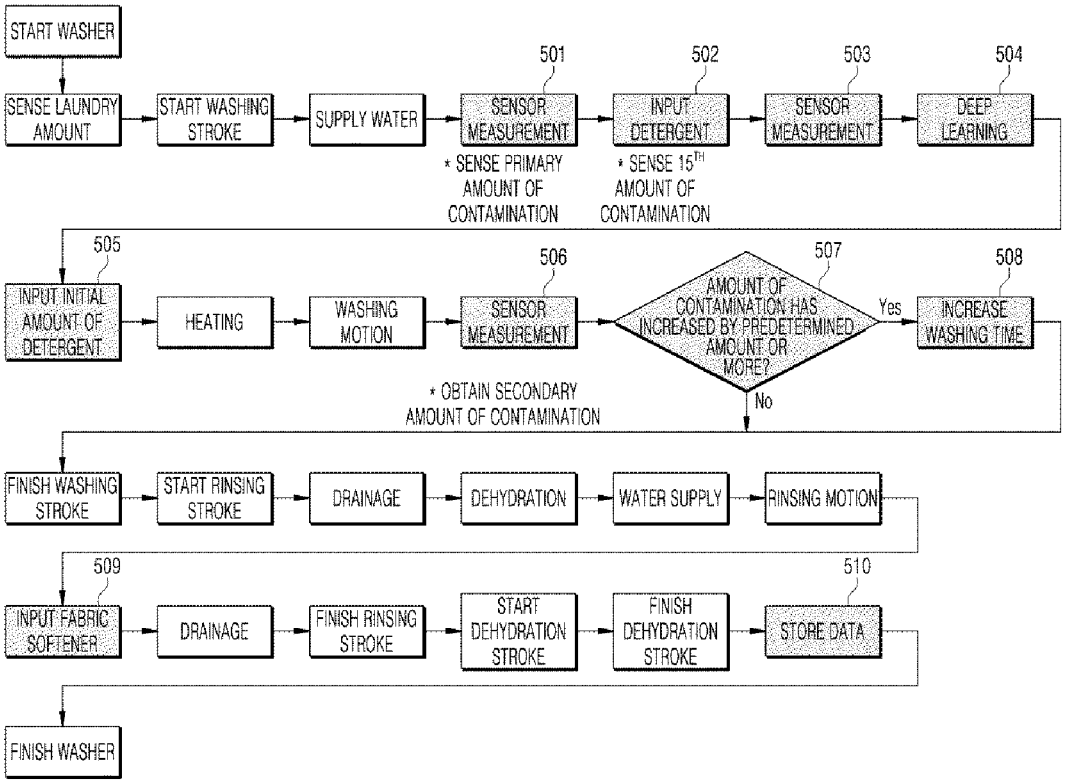
FIG. 5 is a diagram showing a washing process in a washer based on the amount of the contamination according to an embodiment of the present disclosure.

FIG. 5 is a diagram showing a washing process in a washer based on the amount of the contamination according to an embodiment of the present disclosure.

Referring to FIG. 5, when receiving a washing start command from a user, the washer based on the amount of the contamination senses the amount (weight) of the laundry input to an inner tub, and starts a washing stroke. The washer based on the amount of the contamination may supply the washing water to the outer tub of the washer, and then obtain the primary amount of contamination of the washing water by using a turbidity sensing sensor (501).

The washer based on the amount of the contamination may control the automatic detergent dispenser to perform a preprocessing washing by inputting a predetermined small amount of the detergent to the washing water (502), and then obtain the $1.5^{th}$ amount of the contamination of the washing water by using the turbidity sensing sensor (503).

The washer based on the amount of the contamination may perform deep learning (504), decide the initial amount of the detergent, and control an automatic detergent dispenser to input the detergent to the washing water by the decided initial amount of the detergent (505). At this time, the washer based on the amount of the contamination may use, as an input value, at least one information among the primary amount of the contamination, the $1.5^{th}$ amount of the contamination, the amount of the laundry, the temperature of the washing water, the operating course of the laundry, and the type of the laundry, and decide the initial amount of the detergent by using the deep neural network model trained to determine the amount of the detergent necessary for washing according to the input value.

The washer based on the amount of the contamination may perform a washing motion after heating the washing water, and obtain the secondary amount of the contamination of the washing water by using the turbidity sensing sensor, when a predetermined time has elapsed (506). That is, the washer based on the amount of the contamination may obtain the secondary amount of the contamination at the time point when the washing stroke is performed for a predetermined time based on the time point when the initial amount of the detergent has been input.

The washer based on the amount of the contamination may compare the $1.5^{th}$ amount of the contamination (or, primary amount of the contamination) with the secondary amount of the contamination (507). At this time, when obtaining the $1.5^{th}$ amount of the contamination, the washer based on the amount of the contamination may compare the $1.5^{th}$ amount of the contamination and the secondary amount of the contamination, but is not limited thereto. For example, the washer based on the amount of the contamination may compare the primary amount of the contamination and the secondary amount of the contamination when the $1.5^{th}$ amount of the contamination is not obtained.

As the result of comparing the $1.5^{th}$ amount of the contamination (or, primary amount of the contamination) with the secondary amount of the contamination, when the secondary amount of the contamination has increased by a predetermined value or more compared to the $1.5^{th}$ amount of the contamination, the washer based on the amount of the contamination may change the washing stroke based on the increased amount of the contamination. For example, as the result of comparing the $1.5^{th}$ amount of the contamination (or, primary amount of the contamination) with the secondary amount of the contamination, when the secondary amount of the contamination has increased by the predetermined value or more compared to the $1.5^{th}$ amount of the contamination (or, primary amount of the contamination), the washer based on the amount of the contamination may decide an additional washing time based on the increased amount of the contamination, and change the washing stroke so that the additional washing time is added to the initial washing time decided according to the amount of the laundry and the primary amount of the contamination (508). In addition, the washer based on the amount of the contamination may further determine the additional amount of the detergent, and control the automatic detergent dispenser to additionally input the detergent to the washing water by the additional amount of the detergent, based on the increased amount of the contamination, thereby changing the washing stroke.

As the result of comparing the $1.5^{th}$ amount of the contamination (or, primary amount of the contamination) with the secondary amount of the contamination, when the secondary amount of the contamination has not been increased by a predetermined value or more compared to the $1.5^{th}$ amount of the contamination (or, primary amount of the contamination), the washer based on the amount of the contamination does not change the washing stroke.

The washer based on the amount of the contamination may start a rinsing stroke when the washing stroke is finished. The washer based on the amount of the contamination may sequentially perform drainage, dehydration, water supply, and rinsing motion processes, as the rinsing stroke, and control the automatic detergent dispenser to input the fabric softener to the washing water when the laundry is clean and the rinsing is required no longer (509). At this time, the washer based on the amount of the contamination may input the fabric softener in a state where the rinsing motion has been completed after water supply so that the fabric softener may be maintained in the laundry for a long time, unlike that the fabric softener is input when supplying water in the rinsing stroke process in the conventional washing process.

Thereafter, the washer based on the amount of the contamination may perform a draining process to finish the rinsing stroke.

Thereafter, the washer based on the amount of the contamination may perform a dehydration stroke to finish washing. At this time, the washer based on the amount of the contamination may store the data information in the memory after the dehydration stroke has been finished (510). Here, the data information may include at least one information among the amount of the laundry, the primary amount of the contamination, the $1.5^{th}$ amount of the contamination, the secondary amount of the contamination, the temperature of the washing water, the operating course of the laundry, the type of the laundry, the initial amount of the detergent, the additional amount of the detergent, the initial washing time, and the additional washing time.

Figure 6:
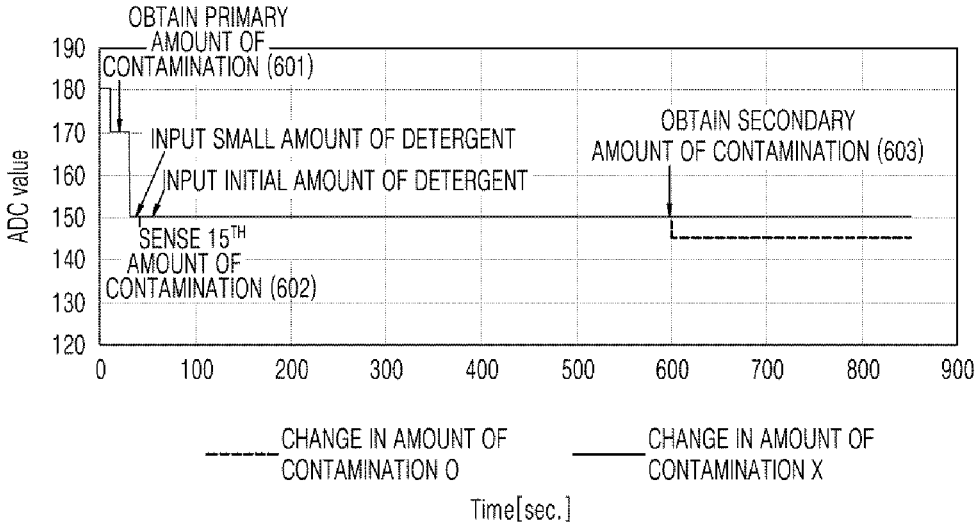
FIG. 6 is a diagram for explaining the time point of obtaining the amount of the contamination in a washer based on the amount of the contamination according to an embodiment of the present disclosure.

FIG. 6 is a diagram for explaining the time point of obtaining the amount of the contamination in a washer based on the amount of the contamination according to an embodiment of the present disclosure.

Referring to FIG. 6, when the washing water is supplied to the outer tub of the washer, the washer based on the amount of the contamination may rotate the inner tub of the washer to perform washing of the laundry. At this time, the washer based on the amount of the contamination may obtain the primary amount of the contamination of the washing water by using the turbidity sensing sensor (601). Here, the washer based on the amount of the contamination may sense the contamination levels before and after the washing water is contaminated by the laundry through the turbidity sensing sensor, respectively, to generate a reference sensed value and a first contamination sensed value, and obtain, as the primary amount of the contamination, a difference between the reference sensed value and the first contamination sensed value.

The washer based on the amount of the contamination may control the automatic detergent dispenser, perform a preprocessing washing by inputting a predetermined small amount of the detergent to the washing water, and then obtain the $1.5^{th}$ amount of the contamination of the washing water by using the turbidity sensing sensor (602). Here, the washer based on the amount of the contamination may sense the contamination level after the preprocessing washing through the turbidity sensing sensor to generate an intermediate contamination sensed value, and obtain, as the $1.5^{th}$ amount of the contamination, a difference between the intermediate contamination sensed value and the previously generated first contamination sensed value.

The washer based on the amount of the contamination may decide an initial amount of the detergent based on at least one of the amount of the laundry, the primary amount of the contamination, and the $1.5^{th}$ amount of the contamination, and input the detergent to the washing water by the initial amount of the detergent.

Thereafter, the washer based on the amount of the contamination may obtain the secondary amount of the contamination of the washing water by using the turbidity sensing sensor, when the washing motion is performed for a predetermined time after the detergent of the initial amount of the detergent has been input (603). At this time, the washer based on the amount of the contamination may sense the contamination level through the turbidity sensing sensor to generate a second contamination sensed value by sensing the contamination level, at the time point when the washing stroke has been performed for a predetermined time after the detergent of the initial amount of the detergent has been input, and obtain, as the secondary amount of the contamination, a difference between the second contamination sensed value and the previously generated intermediate contamination sensed value (or, first contamination sensed value).

The washer based on the amount of the contamination may compare the $1.5^{th}$ amount of the contamination (or, primary amount of the contamination) and the secondary amount of the contamination, and change the washing stroke (for example, additionally washing by the additional washing time and input the additional amount of the detergent) based on the increased amount of the contamination, when the secondary amount of the contamination has increased by a predetermined value or more compared to the $1.5^{th}$ amount of the contamination (or, primary amount of the contamination) as the comparison result.

Figure 7:
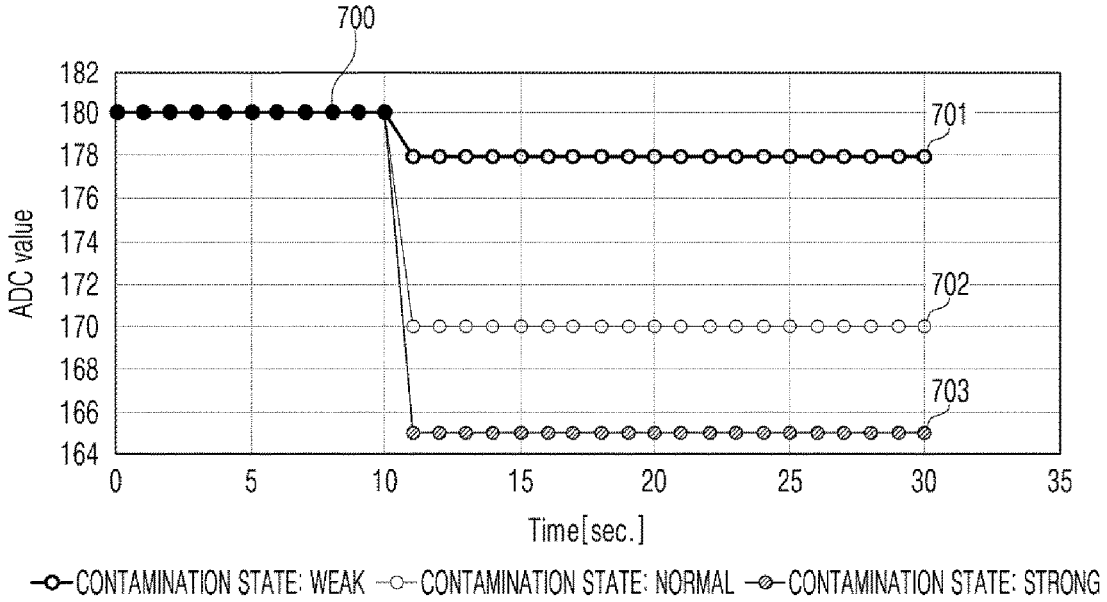
FIG. 7 is a diagram for explaining an example of sensing the amount of the contamination in a washer based on the amount of the contamination according to an embodiment of the present disclosure.

FIG. 7 is a diagram for explaining an example of sensing the amount of the contamination in a washer based on the amount of the contamination according to an embodiment of the present disclosure.

Referring to FIG. 7, the washer based on the amount of the contamination may first sense the contamination level of the washing water through the turbidity sensing sensor, when the washing water is supplied to the outer tub of the washer. That is, before the washing water is contaminated by the laundry, the washer based on the amount of the contamination may sense the contamination level of the washing water through the turbidity sensing sensor to generate a reference sensed value (for example, 180) (the sensed result value of the turbidity sensing sensor) as a contamination amount reference value (700).

Thereafter, the washer based on the amount of the contamination may rotate the inner tub of the washer to perform washing of laundry. At this time, the washer based on the amount of the contamination may obtain the primary amount of the contamination of the washing water through the turbidity sensing sensor. That is, the washer based on the amount of the contamination may sense the contamination level of the contaminated washing water through the turbidity sensing sensor as the washing water contacts the laundry to generate a contamination sensed value (a sensed result value of the turbidity sensing sensor), and obtain, as the primary amount of the contamination, a difference between the reference sensed value and the contamination sensed value (that is, the result value obtained by subtracting the contamination sensed value from the reference sensed value). Here, the sensed value sensed through the turbidity sensing sensor may be a lower value as the contamination level is higher.

At this time, the washer based on the amount of the contamination may confirm a section to which the primary amount of the contamination belongs based on the contamination state for each section (a first section 0 to 5 or less: contamination state 'weak,' a second section of more than 5 to 10 or less: contamination state 'normal,' and a third section of more than 10 to 15 or less: contamination state 'strong'), and decide the initial amount of the detergent according to the contamination state corresponding to the confirmed section, or decide the initial amount of the detergent in proportion to the primary amount of the contamination. In addition, the washer based on the amount of the contamination may also decide the initial amount of the detergent by using the deep neural network model trained to determine the amount of the detergent based on the amount of the contamination.

When deciding the initial amount of the detergent by using the contamination state for each section, the washer based on the amount of the contamination may obtain the result value 2, obtained by subtracting the contamination sensed value 178 from the reference sensed value 180 as the primary amount of the contamination, when the contamination sensed value is, for example, 178 (701). The washer based on the amount of the contamination may confirm the first section as a section to which the primary amount of the contamination 2 belongs, and may confirm that the contamination state corresponding to the first section is 'weak.' The washer based on the amount of the contamination may decide the initial amount of the detergent by confirming the amount of the detergent corresponding to the 'weak' contamination state, based on a predetermined amount of the detergent for each contamination state. Here, the initial amount of the detergent may increase more as the contamination state is stronger.

In addition, when the contamination sensed value is 170 (702), as a first contamination level 10 belongs to the second section, the washer based on the amount of the contamination may confirm that the contamination state corresponding to the second section is 'normal,' and decide the initial amount of the detergent by confirming the amount of the detergent corresponding to the 'normal' contamination state.

When the contamination sensed value is 165 (703), as the first contamination level 15 belongs to the third section, the washer based on the amount of the contamination may confirm that the contamination state corresponding to the third section is 'strong,' and decide the initial amount of the detergent by confirming the amount of the detergent corresponding to the 'strong' contamination state.

The washer based on the amount of the contamination may decide the initial amount of the detergent by using the contamination state for each section, but is not limited thereto, and may use the contamination state for each section even when deciding the additional amount of the detergent.

Figure 8:
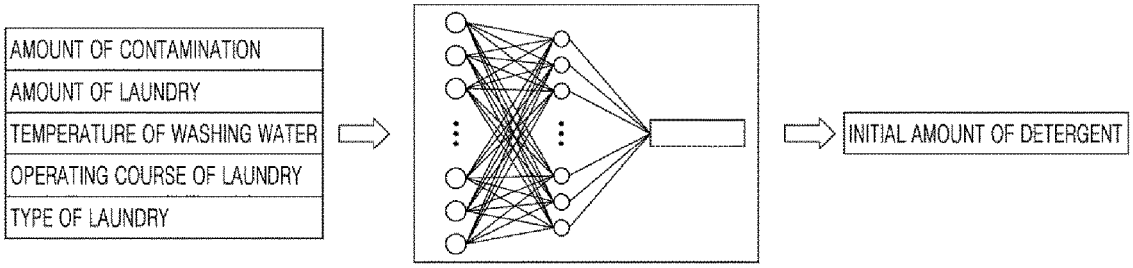
FIG. 8 is a diagram for explaining an example of deciding the initial amount of the detergent by using a deep neural network model in a washer based on the amount of the contamination according to an embodiment of the present disclosure.

FIG. 8 is a diagram for explaining an example of deciding the initial amount of the detergent by using a deep neural network model in a washer based on the amount of the contamination according to an embodiment of the present disclosure.

Referring to FIG. 8, the washer based on the amount of the contamination may decide information (for example, the initial amount of the detergent, the additional washing time, the additional amount of detergent, and the like) necessary for the washing progressing process based on artificial intelligence (AI).

Artificial intelligence refers to a field of studying artificial intelligence or a methodology for creating the same. Moreover, machine learning refers to a field of defining various problems dealing in an artificial intelligence field and studying methodologies for solving the same. In addition, machine learning may be defined as an algorithm for improving performance with respect to a task through repeated experience with respect to the task.

An artificial neural network (ANN) is a model used in machine learning, and may refer in general to a model with problem-solving abilities, composed of artificial neurons (nodes) forming a network by a connection of synapses. The ANN may be defined by a connection pattern between neurons on different layers, a learning process for updating a model parameter, and an activation function for generating an output value.

The ANN may include an input layer, an output layer, and may selectively include one or more hidden layers. Each layer includes one or more neurons, and the artificial neural network may include synapses that connect the neurons to one another. In an ANN, each neuron may output a function value of an activation function with respect to the input signals inputted through a synapse, weight, and bias.

A model parameter refers to a parameter determined through learning, and may include weight of synapse connection, bias of a neuron, and the like. Moreover, a hyperparameter refers to a parameter which is set before learning in a machine learning algorithm, and includes a learning rate, a number of repetitions, a mini batch size, an initialization function, and the like.

The objective of training an ANN is to determine a model parameter for significantly reducing a loss function. The loss function may be used as an indicator for determining an optimal model parameter in a learning process of an artificial neural network.

The machine learning may be classified into supervised learning, unsupervised learning, and reinforcement learning depending on the learning method.

Supervised learning may refer to a method for training an artificial neural network with training data that has been given a label. In addition, the label may refer to a target answer (or, a result value) to be guessed by the artificial neural network when the training data is inputted to the artificial neural network. Unsupervised learning may refer to a method for training an artificial neural network using training data that has not been given a label. Reinforcement learning may refer to a learning method for training an agent defined within an environment to select an action or an action order for maximizing cumulative rewards in each state.

Machine learning of an artificial neural network implemented as a deep neural network (DNN) including a plurality of hidden layers may be referred to as deep learning, and the deep learning is one machine learning technique.

That is, the washer based on the amount of the contamination may decide information necessary for the washing progressing process based on artificial intelligence, and obtain the information by using a deep neural network model, for example.

Specifically, the washer based on the amount of the contamination may use, as an input value, at least one information among the primary amount of the contamination obtained by using the turbidity sensing sensor after supplying the washing water to the laundry, for example, the $1.5^{th}$ amount of the contamination obtained by using the turbidity sensing sensor after inputting a predetermined small amount of the detergent to the washing water, the amount of the laundry, the temperature of the washing water, the operating course of the laundry, and the type of the laundry, and obtain the initial amount of the detergent as an output value by using the deep neural network model trained to determine the amount of the detergent necessary for washing according to the input value.

In addition, the washer based on the amount of the contamination may use the deep neural network model when deciding the additional washing time (or, the additional amount of detergent). At this time, the washer based on the amount of the contamination may use, as an input value, a change in the amount of the contamination (that is, the difference between the primary amount of the contamination (or, the $1.5^{th}$ amount of the contamination) and the secondary amount of the contamination), and obtain the additional washing time (or, the additional amount of the detergent) as an output value by using the deep neural network model trained to determine the additional washing time (or, the additional amount of the detergent) according to the input value. At this time, in addition to the change in the amount of the contamination, the washer based on the amount of the contamination may further add, as an input value, at least one information among the primary amount of the contamination, the $1.5^{th}$ amount of the contamination, the amount of the laundry, the temperature of the washing water, the operating course of the laundry, and the type of the laundry.

Figure 9:
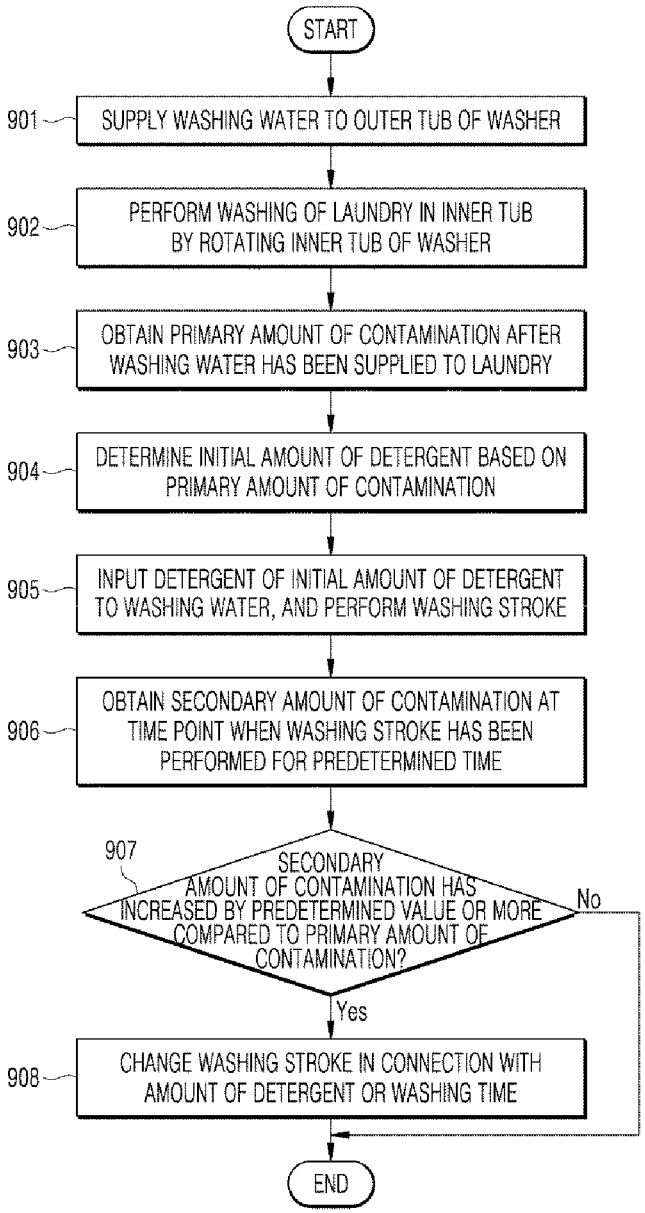
FIG. 9 is a flowchart showing a driving method of a washer based on the amount of the contamination according to an embodiment of the present disclosure.

FIG. 9 is a flowchart showing a method of driving a washer based on the amount of the contamination according to an embodiment of the present disclosure.

Referring to FIG. 9, in operation 901, a water supplier in a washer may supply washing water to an outer tub of the washer according to a washing start command.

In operation 902, a driver in the washer may rotate an inner tub of the washer to perform washing of laundry.

In operation 903, after the washing water is supplied, a controller in the washer may first obtain a primary amount of the contamination by using a turbidity sensing sensor. Here, the turbidity sensing sensor may be disposed to contact the washing water in order to sense the contamination level of the washing water. The turbidity sensing sensor may include an electrical conductivity sensor configured to sense the conductivity of the washing water, an optical sensor configured to sense the light transmittance of the washing water, a temperature sensor configured to sense the temperature of the washing water, and an MCU configured to control the electrical conductivity sensor, the optical sensor, and the temperature sensor. Here, the MCU may calibrate the conductivity sensed by the electrical conductivity sensor and the light transmittance sensed by the optical sensor according to the temperature sensed by the temperature sensor.

When sensing the contamination level, the turbidity sensing sensor may sense the contamination level of the washing water, based on the calibrated conductivity and light transmittance.

When obtaining the primary amount of the contamination, first, the turbidity sensing sensor in the washer may sense the contamination level of the washing water to generate a reference sensed value before the washing water is contaminated by the laundry, and sense the contamination level of the washing water that has been supplied to the laundry and first contaminated by the laundry to generate a first contamination sensed value. Thereafter, the controller in the washer may obtain, as the primary amount of the contamination, a difference between a reference sensed value obtained by the turbidity sensing sensor and the first contamination sensed value.

Thereafter, the driver in the washer may perform preprocessing washing according to the control of the controller, when a predetermined small amount of the detergent is input to the washing water through the automatic detergent dispenser.

In operation 904, the controller in the washer may decide the initial amount of the detergent based on the obtained primary amount of the contamination. At this time, the controller may further obtain the $1.5^{th}$ amount of the contamination after the preprocessing washing by using the turbidity sensing sensor, and decide the initial amount of the detergent, additionally based on the $1.5^{th}$ amount of the contamination, together with the amount of the laundry and the primary amount of the contamination.

In order to obtain the $1.5^{th}$ amount of the contamination, the turbidity sensing sensor in the washer may generate an intermediate contamination sensed value by sensing the contamination level of the washing water after preprocessing washing. The controller in the washer may obtain, as the $1.5^{th}$ amount of the contamination, a difference between the first contamination sensed value and the intermediate contamination sensed value.

When deciding the initial amount of the detergent, the controller may use, as an input value, at least one information among the primary amount of the contamination, the $1.5^{th}$ amount of the contamination, the amount of the laundry, the temperature of the washing water, the operating course of the laundry, and the type of the laundry, and decide the initial amount of the detergent by using the deep neural network model trained to determine the amount of the detergent necessary for washing according to the input value.

In operation 905, the controller in the washer may control the automatic detergent dispenser to input the detergent of the decided initial amount of the detergent to the washing water, and then to perform the washing stroke.

In operation 906, the controller in the washer may obtain a secondary amount of the contamination by using the turbidity sensing sensor at the time point when the washing stroke has been performed for a predetermined time. In order to obtain the secondary amount of the contamination, the turbidity sensing sensor in the washer may sense the contamination level of the washing water to generate a second contamination sensed value at the time point when the washing stroke has been performed for the predetermined time after the detergent of the initial amount of the detergent has been input. The controller in the washer may obtain, as the secondary amount of the contamination, a difference between the first contamination sensed value (or, the intermediate contamination sensed value) and the second contamination sensed value.

In operation 907, the controller in the washer may compare the primary amount of the contamination (or, the $1.5^{th}$ amount of the contamination) and the secondary amount of the contamination, and change the washing stroke related to the amount of the detergent or the washing time based on the increased amount of the contamination in operation 908, when the secondary amount of the contamination has increased by a predetermined value or more compared to the primary amount of the contamination (or, the $1.5^{th}$ amount of the contamination) as the comparison result.

Specifically, the controller in the washer may decide an additional washing time based on the increased amount of the contamination, and change the washing stroke so that the additional washing time is added to the initial washing time decided according to the amount of the laundry and the primary amount of the contamination.

In addition, for another example, the controller in the washer may control the automatic detergent dispenser to further decide the additional amount of detergent based on the increased amount of the contamination, and to additionally input the detergent to the washing water by the decided additional amount of detergent. At this time, the controller in the washer may stop the washing stroke, and then generate notification of the detergent additional supply to the automatic detergent dispenser when a difference between the remaining detergent and the additional amount of the detergent is a predetermined reference value or more in the case where the remaining detergent of the automatic detergent dispenser is smaller than the additional amount of the detergent. On the other hand, the controller in the washer may control the automatic detergent dispenser so that all of the remaining detergents are input to the washing water when the difference is smaller than the predetermined reference value.

In addition, the controller in the washer may decide the amount of the fabric softener based on the amount of the laundry, when the rinsing stroke for the laundry is performed after the washing stroke. The controller in the washer may control the automatic detergent dispenser to input the fabric softener to the washing water by the decided amount of the fabric softener.

The embodiments of the present disclosure described above may be implemented through computer programs executable through various components on a computer, and such computer programs may be recorded in computer-readable media. For example, the recording media may include magnetic media such as hard disks, floppy disks, and magnetic media such as a magnetic tape, optical media such as CD-ROMs and DVDs, magneto-optical media such as floptical disks, and hardware devices specifically configured to store and execute program commands, such as ROM, RAM, and flash memory.

Meanwhile, the computer programs may be those specially designed and constructed for the purposes of the present disclosure or they may be of the kind well known and available to those skilled in the computer software arts. Examples of program code include both machine codes, such as produced by a compiler, and higher level code that may be executed by the computer using an interpreter.

As used in the present application (especially in the appended claims), the terms "a/an" and "the" include both singular and plural references, unless the context clearly conditions otherwise. Also, it should be understood that any numerical range recited herein is intended to include all sub-ranges subsumed therein (unless expressly indicated otherwise) and accordingly, the disclosed numeral ranges include every individual value between the minimum and maximum values of the numeral ranges.

Operations constituting the method of the present disclosure may be performed in appropriate order unless explicitly described in terms of order or described to the contrary. The present disclosure is not necessarily limited to the order of operations given in the description. All examples described herein or the terms indicative thereof ("for example," etc.) used herein are merely to describe the present disclosure in greater detail. Accordingly, it should be understood that the scope of the present disclosure is not limited to the example embodiments described above or by the use of such terms unless limited by the appended claims. Accordingly, it should be understood that the scope of the present disclosure is not limited to the example embodiments described above or by the use of such terms unless limited by the appended claims. Also, it should be apparent to those skilled in the art that various alterations, substitutions, and modifications may be made within the scope of the appended claims or equivalents thereof.

Accordingly, technical ideas of the present disclosure are not limited to the above-mentioned embodiments, and it is intended that not only the appended claims, but also all changes equivalent to claims, should be considered to fall within the scope of the present disclosure.

What is claimed is:

1. A washer configured to adjust an amount of detergent, the washer comprising:

an outer tub configured to receive washing water;

an inner tub disposed in the outer tub and configured to receive laundry;

a water supplier configured to supply washing water to the outer tub;

a driver configured to perform washing of laundry based on rotating the inner tub;

a turbidity sensor configured to contact the washing water to thereby sense a contamination level of the washing water;

an automatic detergent dispenser configured to dispense detergent to the washing water; and a controller configured to:

obtain a primary amount of contamination by the turbidity sensor after the washing water has been supplied, determine an initial amount of detergent to be dispensed based on the primary amount of contamination, control the automatic detergent dispenser to dispense the initial amount of detergent to the washing water, perform a washing stroke by the driver based on the initial amount of detergent being dispensed to the washing water, obtain a secondary amount of contamination by the turbidity sensor based on performance of the washing stroke for a predetermined duration, based on the secondary amount of contamination being increased by a predetermined value or more from the primary amount of contamination, change the washing stroke based on an increased amount of contamination corresponding to a difference between the secondary amount of contamination and the primary amount of contamination, determine an additional amount of detergent based on the increased amount of contamination, control the automatic detergent dispenser to dispense the additional amount of detergent to the washing water, based on a difference between a remaining amount of detergent in the automatic detergent dispenser and the additional amount of detergent being greater than or equal to a predetermined reference value, stop the washing stroke and then control the automatic detergent dispenser to generate a notification for additional supply of detergent, and based on the difference between the remaining amount of detergent and the additional amount of detergent being less than the predetermined reference value, control the automatic detergent dispenser to dispense all of the remaining amount of detergent to the washing water.

2. The washer of claim 1, wherein the driver is configured to, according to control of the controller, perform a preprocessing washing operation in which a first predetermined amount of detergent is dispensed to the washing water through the automatic detergent dispenser, and wherein the controller is configured to determine the initial amount of detergent based on (i) a preprocessing amount of contamination sensed by the turbidity sensor after performance of the preprocessing washing operation, (ii) an amount of laundry received in the inner tub, and (iii) the primary amount of contamination.

3. The washer of claim 2, wherein the controller is configured to:

determine an input value based on at least one of the primary amount of contamination, the preprocessing amount of contamination, the amount of laundry, a temperature of the washing water, an operating course corresponding to the laundry, or a type of laundry corresponding to the laundry; and determine the initial amount of detergent by providing the input value to a deep neural network model that is trained to determine an amount of detergent necessary for washing.

4. The washer of claim 1, wherein the controller is configured to:

determine an initial washing time according to an amount of laundry received in the inner tub and the primary amount of contamination;

determine an additional washing time based on the increased amount of contamination; and change the washing stroke by adding the additional washing time to the initial washing time.

5. The washer of claim 1, wherein the turbidity sensor comprises an electrical conductivity sensor configured to sense a conductivity of the washing water and an optical sensor configured to sense a light transmittance of the washing water.

6. The washer of claim 5, wherein the turbidity sensor further comprises a temperature sensor configured to sense a temperature of the washing water.

7. The washer of claim 6, wherein the turbidity sensor further comprises a micro controller unit (MCU) configured to:

control the electrical conductivity sensor, the optical sensor, and the temperature sensor; and calibrate the conductivity sensed by the electrical conductivity sensor and the light transmittance sensed by the optical sensor according to the temperature of the washing water sensed by the temperature sensor.

8. The washer of claim 7, wherein the turbidity sensor is configured to sense the contamination level of the washing water based on the conductivity and the light transmittance that are calibrated based on the temperature of the washing water.

9. The washer of claim 1, wherein the controller is configured to:

based on performing a rinsing stroke after performance of the washing stroke, determine an amount of fabric softener based on an amount of laundry received in the inner tub; and control the automatic detergent dispenser to dispense the amount of fabric softener to the washing water.

10. The washer of claim 1, wherein the turbidity sensor is configured to:

generate a reference value corresponding to a contamination level of washing water sensed before the washing water is contaminated by the laundry; and generate a first contamination value corresponding to a contamination level of washing water sensed after the washing water has been supplied to the laundry and contaminated by the laundry, and wherein the controller is configured to determine the primary amount of contamination based on a difference between the reference value corresponding to the contamination level of washing water and the first contamination value.

11. The washer of claim 10, wherein the turbidity sensor is configured to generate a second contamination value corresponding to a contamination level of washing water sensed after the washing stroke has been performed for the predetermined duration, and wherein the controller is configured to determine the secondary amount of contamination based on a difference between the first contamination value and the second contamination value.

12. The washer of claim 1, wherein the controller is configured to:

obtain the primary amount of contamination from the turbidity sensor before dispensing the initial amount of detergent to the washing water; and obtain the secondary amount of contamination from the turbidity sensor after performing the washing stroke with the initial amount of detergent for the predetermined duration.

* * * * *